United States Patent [19]

Fisher

[11] 4,051,634

[45] Oct. 4, 1977

[54] REGULATING WHEEL PIVOT ADJUSTING DEVICE

[75] Inventor: Robert Clifford Fisher, Milford, Ohio

[73] Assignee: Cincinnati Milacron Inc., Cincinnati, Ohio

[21] Appl. No.: 655,732

[22] Filed: Feb. 6, 1976

[51] Int. Cl.[2] ..... B24B 5/30

[52] U.S. Cl. ..... 51/103 R

[58] Field of Search ..... 51/103 R, 236, 78, 215.3 F, 51/74 R, 103 TF

[56] References Cited

U.S. PATENT DOCUMENTS

| | | | |
|---|---|---|---|
| 1,190,698 | 7/1916 | Abramsen | 51/103 TF |
| 2,073,079 | 3/1937 | Theler et al. | 51/103 TF |
| 2,137,821 | 11/1938 | Dunbar et al. | 51/103 TF |
| 2,196,108 | 4/1940 | Dunbar et al. | 51/103 TF |
| 2,224,423 | 12/1940 | Binns | 51/103 TF |
| 2,322,619 | 6/1943 | Ekholm | 51/103 TF |
| 3,290,830 | 12/1966 | Ono | 51/103 R |

FOREIGN PATENT DOCUMENTS

| | | | |
|---|---|---|---|
| 391,243 | 4/1953 | United Kingdom | 51/103 TF |

*Primary Examiner*—Harold D. Whitehead
*Assistant Examiner*—Roscoe V. Parker
*Attorney, Agent, or Firm*—Thomas M. Farrell

[57] ABSTRACT

An apparatus for adjusting the regulating wheel pivot in a centerless grinder machine when used for thrufeed grinding, comprising a means for tilting the axis of the regulating wheel to provide a thrufeed vector feed, and further comprising a means for elevating the tilt axis to accommodate a range of workpiece diameters without redressing the shape of the regulating wheel.

3 Claims, 8 Drawing Figures

REGULATING WHEEL PIVOT ADJUSTING DEVICE

BACKGROUND OF THE INVENTION

In centerless grinding art it is common knowledge that to achieve "rounding up" of the workpiece, the axes of the workpiece, grinding wheel, and regulating wheel must not lie in a common plane; i.e., the grinding wheel and the regulating wheel must not contact points on the workpiece which are 180° apart.

The principal reason for this is the fact that if a lobe was present on the workpiece diameter, the workpiece would be thrown toward the grinding wheel when the lobe contacted the regulating wheel; thus, out-of-roundness would be perpetuated.

Most centerless grinders are constructed so that the grinding wheelhead does not move, and is affixed to the base of the machine. The regulating wheelhead is generally attached to a slide housing which may be slid on ways upon the base, toward or away from the grinding wheel. These ways are most generally parallel to some reference on the base, such as the floor line, (however, they may be slid along any other plane which is fixed relative to the base).

The commonly used method of taking the workpiece out of the line of action between the centers of the regulating wheel in the grinding wheel, is generally to elevate the workpiece diameter above the line of centers of the wheels of the machine. Elevation of the part is usually accomplished by means of a workrest blade which supports the workpiece for its entire length during any grinding process, and further supports work which is retracted from the grinding position durin infeed grinding.

Infeed grinding is performed very simply when the workrest blade is attached to the regulating wheel slide housing in a fixed position relative to the regulating wheel. In this manner, when the regulating wheel is retracted from the grinding wheel, a finished workpiece is removed from the workrest blade and a rough workpiece is placed in the crotch formed by the workrest blade and regulating wheel, thereafter to be ground when blade and wheel are advanced toward the grinding wheel. In infeed grinding the axes of rotation of the grinding wheel and regulating wheel lie in a common plane so that only rotary motion is imparted to the workpiece.

In thrufeed grinding, however, it is necessary to provide a component of force to propel a rotating workpiece along an axial path, beginning at the point of entry of the workpiece between the regulating wheel and grinding wheel, and continuing until the finished workpiece then exits from the opposite side of the two wheels at which time the grinding process is complete. This necessary component of force to propel the workpiece along its axial path is derived from the regulating wheel.

The regulating wheel imparts a tangential force to the surface of the workpiece when in its normal position (wheel axis parallel to workpiece axis) therefore, when the regulating wheelhead is swiveled in the vertical plane, vertical and horizontal components of force result from the now-tilted tangential force of the regulating wheel.

However, it is apparent from the "skewed cylinder" effect, that the regulating wheel, when pivoted in a vertical plane, will then only have a point contact with the workpiece and thus be limited to the driving influence it can exert on the workpiece. To establish contact along the entire length of the workpiece then the regulating wheel is dressed with a wheel truing device in such a manner as to dish out the regulating wheel in an axially-curved shape, to create a "wraparound" contact line along the axis of the workpiece to effect regulation of the workpiece travel.

When it becomes necessary to insert a larger or smaller diameter workpiece, the contact line is no longer valid even though the same center height may be maintained. The axis of the regulating wheel may be swiveled to re-establish this contact line. However, this workpiece will no longer be parallel to either the vertical plane of the blade or the axis of the grinding wheel. It then becomes necessary, through dressing the regulating wheel, to alter the difference between the front and rear diameter of the wheel, to re-establish this parallelism. This correction is necessary because the work axis and the swivel axis do not lie in the same plane. This redressing of the regulating wheel consumes an appreciable amount of time, and decreases useful life of the wheel.

It is, therefore, an object of the present invention to obivate and overcome the difficulties involved in the prior art thrufeed device.

Another object of the present invention is to provide a means whereby thrufeed grinding setup may be achieved with minimal time.

A further object of the present invention is to increase life of regulating wheels.

A still further object of this invention is to centralize axial "wraparound" of the regulating wheel with respect to a horizontal plane through the work.

SUMMARY OF THE INVENTION

This invention comprises an apparatus for adjusting the regulating wheel pivot on a centerless grinding machine wherein a pivot is employed to move the centerline of the regulating wheel in a vertical plane so as to impart a component vector of the tangential force exerted by the regulating wheel on the workpiece, to propel the workpiece along an axial path between the regulating wheel and grinding wheel.

In the present invention, a slide housing is located on the machine ways and the regulating wheelhead housing is pivotally adapted to a face of the slide housing which is parallel to the grindng wheel axis. When a curved shape has been dressed into the regulating wheel to provide a "wraparound" contact line, to maintain jurisdiction of the workpiece in its travel, the pivot point is movable in an elevational above the line of centers of the regulating wheel and grinding wheel to adapt the curved shape to workpieces of varying diameters.

Movement of the pivot point is accomplished by means of a slidable block upon which the pivot is located, wherein the block is slidable in the elevational plane and further wherein the block is elevated by a screw and nut system in which the screw is secured to the slide housing of the machine.

The movable block is fitted with a rod which extends into the area where rod position relative to a stationary reference will indicate movement of the pivot block. In the within invention the rod is inscribed with witness lines for visible determination, but it may be seen that automatic or indirect means may also be used for determination of pivot position.

BRIEF DESCRIPTION OF THE DRAWINGS

Other objects and advantages of the invention will become apparent upon reading the following detailed description and upon reference to the drawings, in which.

DETAILED DESCRIPTION OF THE INVENTION

Figure 1:
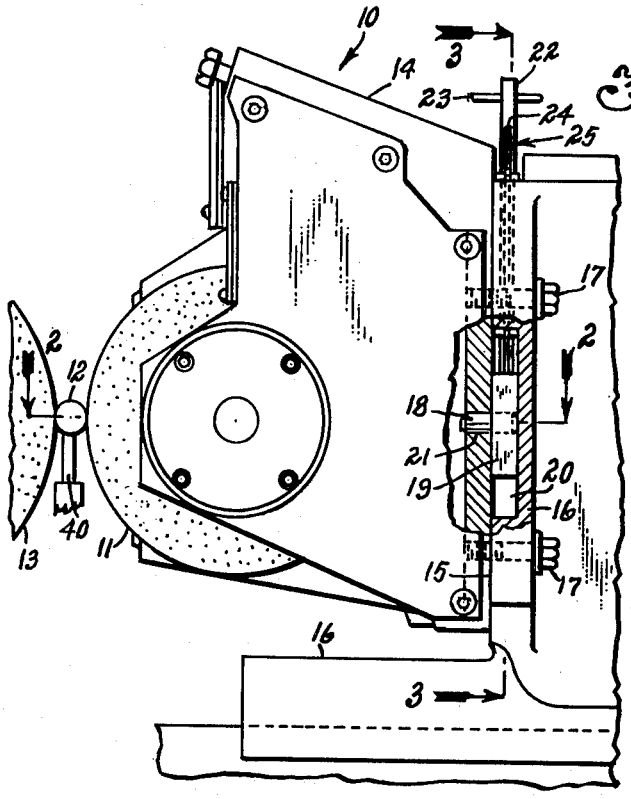
FIG. 1 is a front elevation of a centerless grinding machine emphasizing the regulating wheelhead, slide housing, work and grinding wheel.

Referring now to the drawings, and particularly to FIG. 1 thereof, there is shown in a centerless grinder regulating wheelhead 10 supporting a regulating wheel 11 which is shown in contact with a workpiece 12, and further, which workpiece 12 is shown in contact with a grinding wheel 13. When performing the grinding process known as infeed grinding, the axes of the workpiece 12, regulating wheel 11, and grinding wheel 13 are all parallel.

The regulating wheel housing 14 is clamped to a face 15 of the slide housing 16 which is parallel to the axes of the workpiece 12 and grinding wheel 13. The slide housing 16 is useful for radially positioning the regulating wheel 11 proximate to a workpiece 12 in contact with a grinding wheel 13. Clamp bolts 17 are used to hold the regulating wheel housing 14 against the face 15 of the slide housing 16. For swiveling the regulating wheel housing 14 relative to the workpiece 12, there is employed a pivot pin 18 which is secured to a block 19 which is slidably maintained within a track 20, or groove, in the face 15 of the slide housing 16.

The pivot pin 18 is accurately fitted within a bore 21 of the regulating wheel housing 14 to allow the regulating wheel housing 14 to swivel upon the pivot pin 18 in a vertical plane. The slidable block 19 is adjusted in a vertical position by an elevating screw 22 which is restrained from moving axially in the slide housing 14 and further wherein the elevating screw 22 has a handle 23 upon its topmost end to permit manual turning thereof. An indicator rod 24 is also shown which is secured to the slidable block 19 and engraved witness lines 25 are provided on the exposed portion of the topmost end of the indicator rod 24. Therefore, visible determination of the elevational position of the rod 24, and thus the elevational position of the slidable block 19, and pivot pin 18, may be had.

Figure 2:
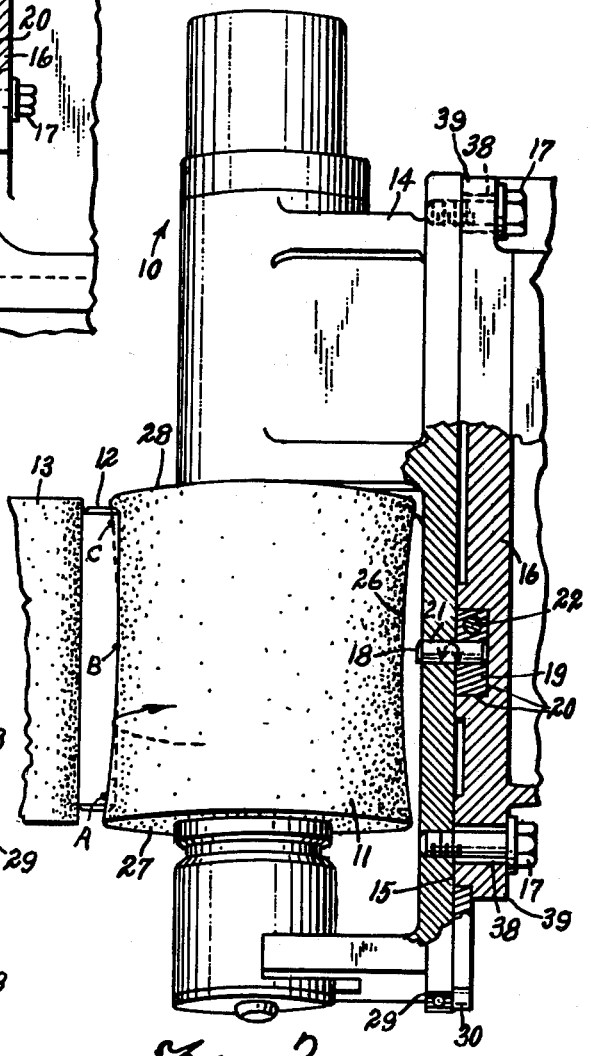
FIG. 2 is a plan section taken along the line 2—2 on FIG. 1 showing the regulating wheel, housing, work, grinding wheel, and pivot mechanism.

Referring now to FIG. 2, is may be seen that, whereas in "infeed" grinding the regulating wheel 11 is of a cylindrical shape and impart only rotary motion to the workpiece 12, the regulating wheelhead 10 must be swiveled in a vertical plane to exert a small component of force to propel the workpiece 12 along its axial path during the process of "thrufeed" grinding. Accordingly, (as depicted in FIG. 2), to maintain the maximum frictional contact with the workpiece 12, the regulating wheel 11 has an axially-shaped curve 26 dressed into its surface by means of a truing device in a conventional manner known in the grinding art. This dressing of the regulating wheel is done to provide a "wraparound" line of contact which will establish contact at points "A", "B", "C".

Further, the wheel 11 is shaped such that the front diameter 27 of the regulating wheel 11 is slightly smaller than its rear diameter 28 to accommodate the diminished diameter of the finished workpiece 12 as it passes through the wheels.

Pivoting in the vertical plane is accomplished by loosening the clamp bolts 17 which secure the regulating wheel housing 14 to the slide housing 16, and thereafter pivoting the regulating wheel housing 14 about the pivot pin 18. The pivot pin 18 as shown in FIG. 2, together with its slidable block 19 and the elvating screw 22 necessary for repositioning the height of the regulating wheel 11 when a larger diameter workpiece is inserted. The angular position of the pivoted regulating wheel housing 14 may be discerned by conbentional means such as a graduated plate 29, corresponding to a scribed line 30 on the fixed, non-pivoting, slide housing 16.

Figure 3:
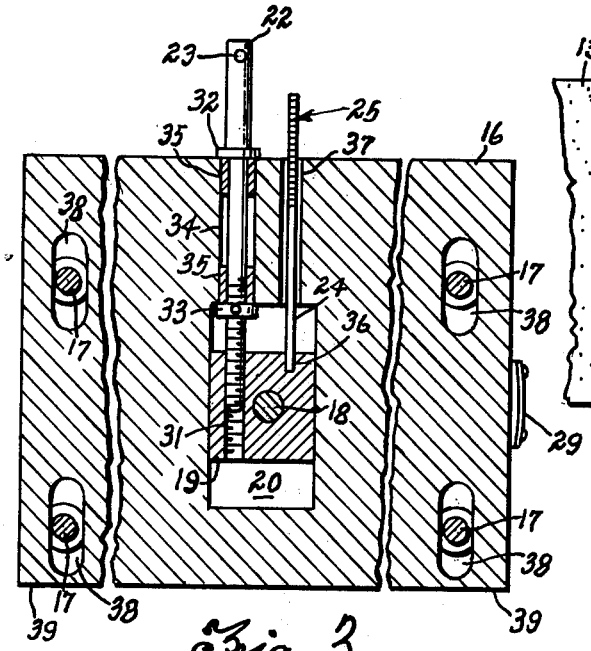
FIG. 3 is an elevational section taken along the line 3—3 of FIG. 1, showing the pivot block, elevation screw, and position indicator rod.

FIG. 3 illustrates the parts necessary to move the pivot point and thus the regulating wheel 11 in a vertical plane. The pivot pin 18 is shown secured in a movable block 19 which is guided in a fitted track 20. The elevating screw 22 is shown threadably engaged in the movable block 19 which has been tapped with a corresponding thread 31. A shoulder 32 has been provided on the handle end of the elevating screw 22 and a collar 33 has been pinned to the lower portion of the elevating screw to prevent axial movement of the screw 22 relative to the slide housing 16. A hole 34 has been provided through the slide housing 16, into which has been pressed a pair of bushings 35 to permit the smooth rotation of the elevation screw 22. The indicator rod 24 has been tightly pressed into a hole 36 in the movable block 19 and it extends up through a clearance hole 37 in the slide housing 16 so that it may be seen from the front of the machine. Witness lines 25 have been inscribed on the indicator rod 24 to show movement and vertical positioning of the rod 24 and thus, the pivot pin 18. The slide housing 16 has been provided with clearance slots 38 at its outermost flanges 39 through which pass the clamp bolts 17 which secure the regulating wheel housing 14; thus, when the regulating wheel housing 14 is swiveled, the clamp bolts 17 are free to move. The graduated plate 29, useful for indicating angular positions of the regulating wheel housing 14, as shown at the front of the slide housing flange 39.

Figure 4:
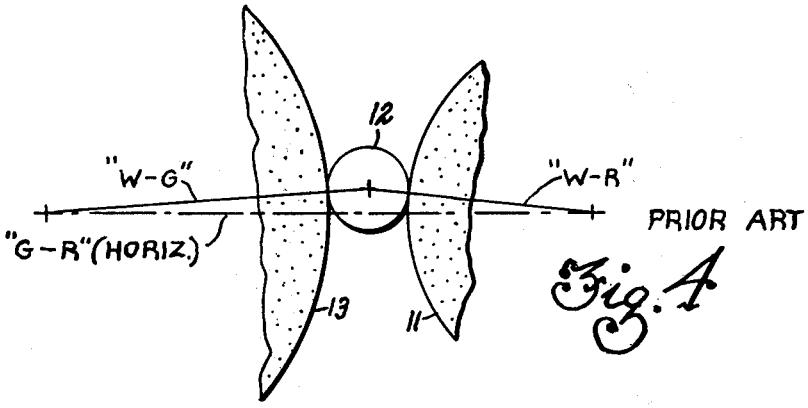
FIG. 4 is a diagramatic drawing showing conventional relationship of regulating wheel, grinding wheel, and workpiece.

Turning now to FIG. 4, there is shown a diagrammatic drawing to illustrate the relative positions of the regulating wheel 11, grinding wheel 13, and workpiece 12 in a typical centerless grinding machine. Thus, it may be seen that to accomplish the "rounding up" of the workpiece 12 the two contact points on the workpiece 12 must not be 180° apart. For usual reference the line of centers of the regulating wheel 11 and grinding wheel 13, "G-R", is parallel to a horizontal plane and the workpiece 12 is raised above that line of center. Therefore, a triangle is established by the lines of centers of the regulating wheel 11 and grinding wheel 13, "G-R", workpiece 12 and grinding wheel 13, "W-G", workpiece 12 and regulating wheel 11, "W-R".

Figure 5:
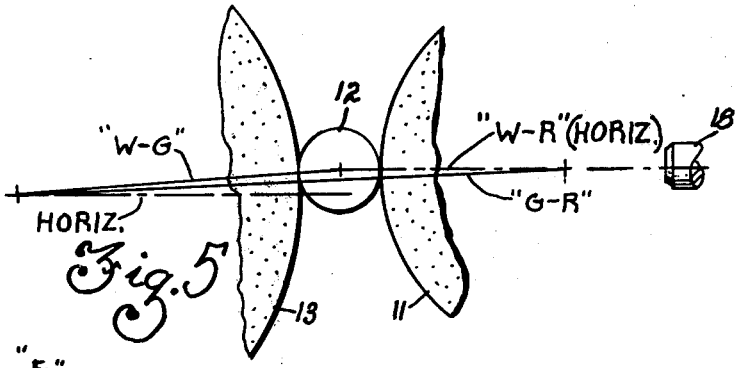
FIG. 5 is a diagramatic drawing showing the relationship of regulatig wheel, workpiece, and grinding wheel, of the within invention, wherein the regulating wheel is elevated in line with the workpiece.

Referring now to FIG. 5, it may be seen that the present invention elevates the center of the regulating wheel 11 along with the workpiece 12 due to any increase in work size. In this fashion the triangle, formed by the above-mentioned lines of centers, is maintained to generate the "rounding up" effect. Thus, the line of centers between the workpiece 12 and regulating wheel 11, "W-R", is collinear with the pivot pin 18 and is elevated above a horizontal line drawn through the center of the grinding wheel 13. Here it should be noted, however, that a horizontal line has been chosen for a convenient reference only and the reference may be a line parallel to a plane in any spatial orientation, depending on the machine, as long as the relative positions of the regulating wheel 11, grinding wheel 13, and workpiece 12 are acted upon by the pivot pin 18 as shown within this invention.

Figure 6:
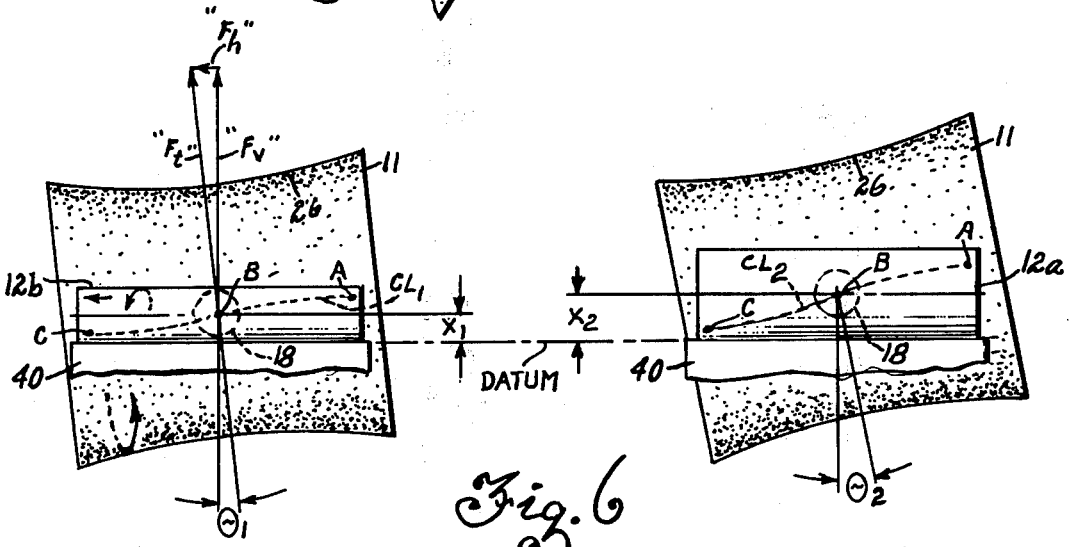
FIG. 6 is a diagramatic drawing illustrating two different workpieces and their relationship to a fixed workrest blade, showing the respective position of the regulating wheel in a thrufeed grinding process.

Reference to FIG. 6 shows clearly what happens when a larger workpiece **12*a* is substituted for a first, smaller workpiece 12*b*. The center height of the smaller workpiece 12*b* is depicted as dimension $X_1$, relative to a datum plane, in this case the workrest blade 40. The centerline of the pivot pin 18 is shown on the same center as the workpiece 12*b*, and the regulating wheel 11 is therefore swiveled to an angle $0_1$ about the pivot point to establish thrufeed motion and to fit the axially shaped curve 26 of the regulating wheel 11 to the workpiece 12*b* establishing contact along the helical "wraparound" contact line "$CL_1$", which touches the workpiece at points "A", "B", and "C", for reference of the reader. The tangential force "FT" exerted by the regulating wheel 11 acts upon the workpiece 12** with its horizontal and vertical components, "FH" and "FV" respectively.

When a larger workpiece **12*a* is set upon the datum plane, (workrest blade 40 in this case), the center of the work moves up to the dimension $X_2$. Thus, by means of the elevational screw 22 (indicated in FIG. 3), the pivot is moved up to the centerline of the workpiece. Further, the regulating wheel 11 is swiveled and additional amount to fit the surface of the regulating wheel 11 snugly against the broader curvature of the workpiece 12, along a new helical "wraparound" contact line, "$CL_2$" at new points "A", "B", and "C". This additional amount of swiveling will turn the regulating wheel 11 into a vertical plane at the angle $0_2$. Thus, it may be seen that a given curvature 26 of regulating wheel 11 may be used for multiple part sizes in the thrufeed grinding process without redressing the regulating wheel 11** in order to fit the changing curvature of workpieces.

Figure 7:
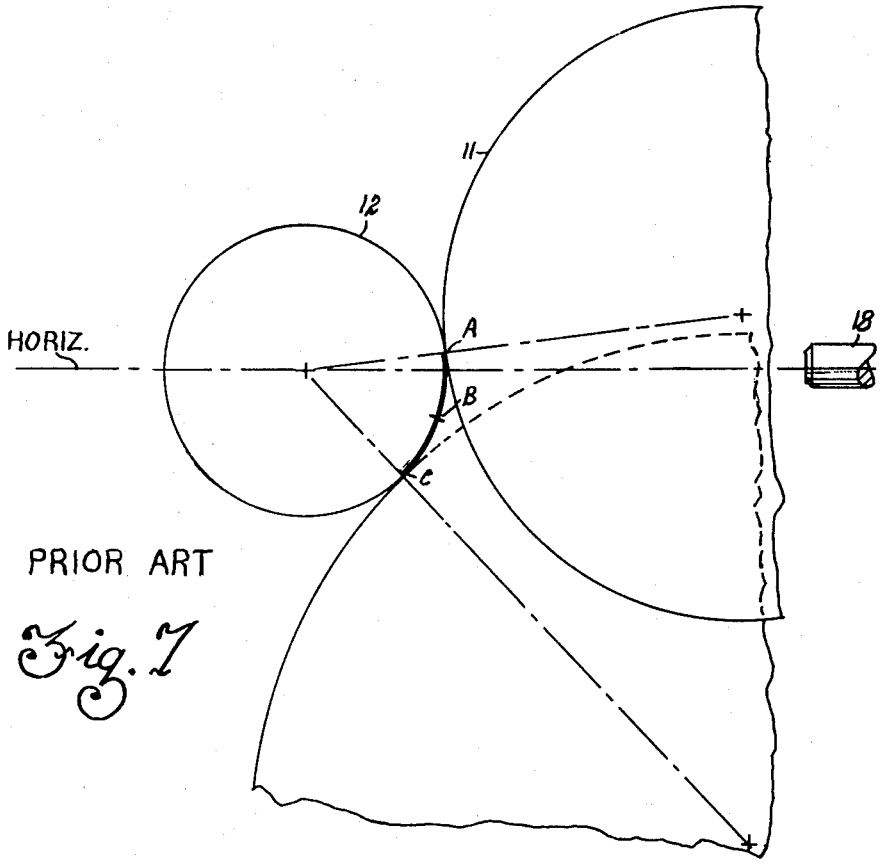
PRIOR ART Fig. 7
FIG. 7 is an elevational diagram illustrating prior art regulating wheel wraparound.

FIG. 7 illustrates the prior art mechanism, which has the pivot pin 18 below the center of the workpiece 12, with respect to a horizontal plane. When the regulating wheel 11 is swiveled, a small amount of the regulating wheel "wraparound" is above the horizontal plane, while the majority of the work contact line is below the horizontal plane. This condition can be responsible for chatter in the work while performing heavy cuts.

Figure 8:
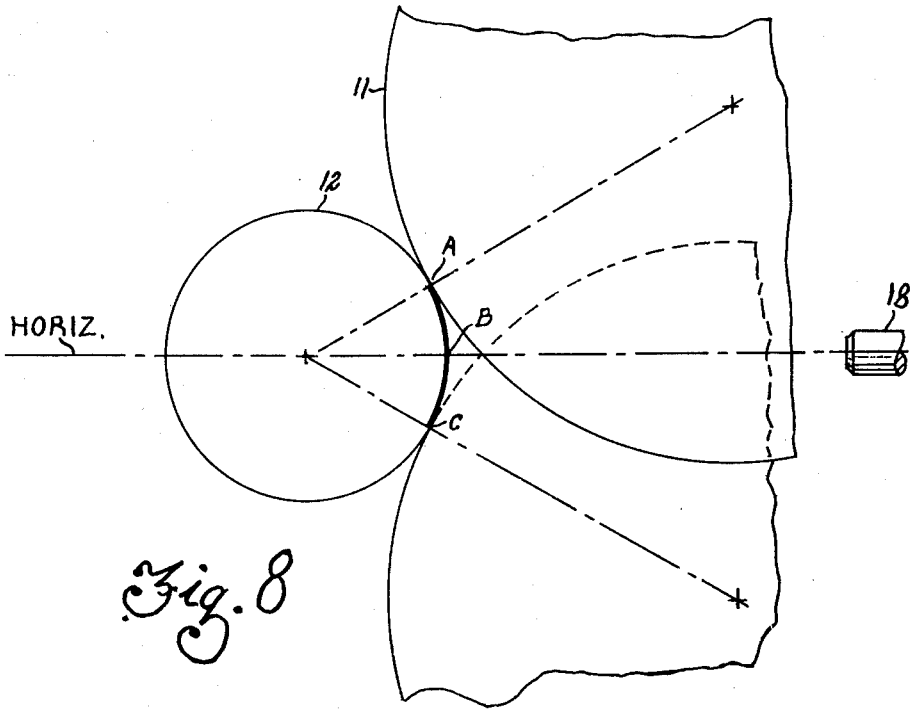
FIG. 8 is an elevational diagram illustrating regulating wheel wraparound of the within invention.

FIG. 8, in comparison to FIG. 7, shows that the within invention keeps the center of the pivot pin 18 on the horizontal plane through the workpiece 12 and, therefore, when the regulating wheel 11 is swiveled, the "wraparound" is more equally positioned above and below the horizontal plane, as shown by contact points "A", "B", and "C".

What is claimed is:

1. In a centerless grinding machine of the type having a base; a grinding wheelhead; a regulating wheelhead adapted to drive and support a workpiece in contact with the grinding wheel, and; a slide supporting one of the grinding and regulating wheelheads and moveable on said base along a feed axis for relative movement of the wheelheads in a grinding operation, wherein said regulating wheelhead is adapted to pivot about a joint so as to pivot said regulating wheelhead in a plane transverse to said feed axis; an improved pivot adjusting device comprising:

means to move said pivot joint along said transverse plane.

2. The pivot device of claim 1, wherein said means to move said pivot joint comprises a block which carries said pivot joint wherein said block is slidably maintained in a track in said slide and a screw and nut system is adapted to move said block in said track.

3. In a centerless grinding machine of the type having a base; a grinding wheelhead fixed to said base; a slide moveable on said base along a feed axis relative to said grinding wheelhead; a regulating wheelhead carried on said slide and adapted to drive and support a workpiece wherein said regulating wheelhead is adapted to pivot about a joint so as to pivot said regulating wheelhead relative to said slide in a plane transverse to said feed axis and further wherein the regulating wheel is directly opposite the grinding wheel in the direction of the feed axis; an improved device to permit adjustment of said pivot joint along said transverse plane comprising:

a block, adapted to carry said pivot joint, wherein said block is slidably maintained in a track in said slide; and a screw and nut system adapted to move said block in said track.

* * * * *